US006993864B1

(12) United States Patent
O'Clair et al.

(10) Patent No.: US 6,993,864 B1
(45) Date of Patent: Feb. 7, 2006

(54) LOCKING BLOCK FOR COMPACT SEMI-AUTOMATIC PISTOLS

(75) Inventors: Sean O'Clair, Feeding Hills, MA (US); Michael J. Poulin, Granby, MA (US); Kevin G. Foley, Springfield, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 10/774,667

(22) Filed: Feb. 9, 2004

Related U.S. Application Data

(60) Provisional application No. 60/446,407, filed on Feb. 11, 2003.

(51) Int. Cl.
*F41A 21/48* (2006.01)

(52) U.S. Cl. ..... 42/75.02; 42/71.02

(58) Field of Classification Search ..... 42/15–18, 42/44, 59, 69.02, 70.01, 70.11, 75.02, 71.02; 89/137, 142, 161–163, 168–176, 180, 187–190, 89/194–196
See application file for complete search history.

(56) References Cited

U.S. PATENT DOCUMENTS 3,656,400 A * 4/1972 Stoner et al. ..... 89/138
3,774,500 A * 11/1973 Into ..... 89/129.01
3,857,325 A 12/1974 Thomas ..... 89/138
4,161,836 A * 7/1979 Hayashi ..... 42/16
4,199,886 A * 4/1980 Deuring ..... 42/44
4,207,798 A * 6/1980 Hayashi ..... 89/191.01
4,344,246 A * 8/1982 Bauman et al. ..... 42/69.03
4,409,882 A * 10/1983 Blackshaw et al. ..... 89/163
4,542,606 A * 9/1985 Hoenig ..... 42/75.02
4,555,861 A * 12/1985 Khoury ..... 42/69.01
4,589,327 A * 5/1986 Smith ..... 89/148
4,594,935 A * 6/1986 Smith ..... 89/176
4,602,450 A * 7/1986 Hoenig ..... 42/75.02
4,915,011 A * 4/1990 Smith ..... 89/176
4,926,739 A * 5/1990 Byron ..... 89/1.4
5,050,481 A * 9/1991 Knight et al. ..... 89/147
5,159,137 A * 10/1992 Brennan ..... 42/75.02
5,225,612 A * 7/1993 Bernkrant ..... 42/70.02
5,386,659 A 2/1995 Vaid et al. ..... 42/69.02
5,655,326 A * 8/1997 Levavi et al. ..... 42/70.01
5,669,169 A * 9/1997 Schmitter et al. ..... 42/75.01
5,701,698 A * 12/1997 Wesp et al. ..... 42/69.02
5,717,156 A 2/1998 Lenkarski ..... 89/106
5,734,120 A 3/1998 Besselink ..... 89/163
5,741,996 A * 4/1998 Ruger et al. ..... 89/196
5,983,773 A * 11/1999 Dionne ..... 89/29
6,112,636 A * 9/2000 Besselink ..... 89/191.01
6,234,059 B1 * 5/2001 Fuchs et al. ..... 89/196

(Continued)

*Primary Examiner*—Stephen M. Johnson
(74) *Attorney, Agent, or Firm*—McCormick, Paulding & Huber LLP

(57) ABSTRACT

A locking block mechanism for a compact semiautomatic pistol includes a pair of forward guide rails, which are normally separate from the locking block. Additionally, the locking block includes transverse ribs on the sides of the locking block, which engage mating slots in the polymeric frame of the pistol and secure the block to the frame. The guide rails and transverse ribs are separated by a space or discontinuity on the side wall of the locking block. The guide rails include chamfered front and rear edge surfaces and arcuate, convex bottom surfaces. The above-mentioned features function to create a durable locking block that allows for the construction of a pistol that is more compact than prior art designs.

13 Claims, 5 Drawing Sheets

U.S. PATENT DOCUMENTS 6,393,751 B1 * 5/2002 Liebenberg ..... 42/75.01
6,401,379 B1 * 6/2002 Moon ..... 42/71.02
6,405,631 B1 * 6/2002 Milek ..... 89/139
6,418,655 B1 * 7/2002 Kay ..... 42/75.02
6,560,909 B2 * 5/2003 Cominolli ..... 42/70.05
6,789,342 B2 * 9/2004 Wonisch et al. ..... 42/75.02

* cited by examiner

LOCKING BLOCK FOR COMPACT SEMI-AUTOMATIC PISTOLS

CROSS REFERENCE TO RELATED APPLICATION

This application claims the benefit of U.S. Provisional Patent Application Ser. No. 60/446,407, filed on Feb. 11, 2003, entitled "COMPACT LOCKING BLOCK FOR SEMI-AUTOMATIC PISTOLS" herein incorporated by reference in its entirety.

FIELD OF THE INVENTION

The present invention relates generally to a locking block for a semiautomatic pistol and more particularly to a locking block for a compact, polymer frame, high-powered pistol that combines the normally separate guide rails with the locking block.

BACKGROUND OF THE INVENTION

Semi-automatic pistols can be divided into a number of different types. These include pistols that use a blowback mechanism and those that utilize a short-recoil Browning-type mechanism.

With blowback pistols, only the slide moves relative to the frame of the gun upon discharge. The barrel of a blowback pistol is fixed to the frame but the slide is not secured to the barrel. Immediately after firing the pistol, the recoil force starts to drive the slide rearward commencing the extraction of the spent cartridge case. Accordingly, part of the extraction of the case occurs during the high-pressure period of the firing cycle. If the slide is too light the case is extracted too soon affecting the loading cycle. The blowback mechanism is typically used with low-powered cartridges. Semi-automatic pistols for higher-powered cartridges generally utilize a short-recoil mechanism.

With short-recoil operated pistols, both the barrel and slide move together rearward upon discharge of the gun. Prior to the firing of the cartridge, the barrel is engaged to the slide by a locking mechanism. After firing, the recoil force drives both the slide and barrel rearward, but since they are in engagement, the extraction of the case has not started. After the high-pressure period has passed, an actuator begins to disengage the barrel from the slide. The barrel travels a short distance before coming to rest forward of the magazine, hence short-recoil, and is completely disengaged from the slide. The slide continues and begins extraction of the spent cartridge case using its kinetic energy and the residual gas pressure in the barrel. After extraction, the spent case is ejected. The slide continues until full travel is reached.

In short-recoil operated pistols, the barrel may be locked to the slide by a number of locking mechanisms. The barrel may be provided with peripheral ribs, studs, lugs or other mechanism and may be rotated, cammed or otherwise engaged and disengaged from the slide. Alternatively, a separate locking block may be used to lock the barrel to the slide. A common method utilizing a locking block is the dropping barrel method as depicted in U.S. Pat. No. 4,915,011 hereby incorporated by reference in its entirety.

In the dropping barrel method of locking, the barrel is slidably mounted for straight line longitudinal motion, and the locking mechanism comprises a separate locking block provided with an actuation mechanism for engaging the barrel to the slide. The actuation mechanism comprises a cam in the frame to drive the barrel downwardly from engagement with the slide during initial rearward movement of the slide from the battery position and upwardly to engage the barrel to the slide during final movement of the slide to the forward battery position.

In metal frame pistols, the slide is usually secured for such movement by longitudinally spaced pairs of metal guide rails. The guide rails generally include four rails, one forward and one rearward pair.

In recent years there has been a trend in the firearm industry to utilize polymers in the manufacture of semi-automatic pistols, particularly in fabricating unitary frames therefor by injection molding techniques. Generally, in such frames, the front pair and rear pair or spaced guide rails are partially embedded in the polymer of the frame. The cam, which is part of the locking block, is assembled into the frame and held by cross pins. The locking block is located between the two sets of rails. Polymer frame pistols are desirable in that they are lighter than pistols with metal frames.

Currently, firearm manufacturers are making compact polymer frame pistols which feature a reduced length frame, slide and barrel as disclosed in U.S. Pat. No. 5,717,156, which is hereby incorporated by reference in its entirety. Compact pistols are smaller and lighter than standard size semi-automatic pistols. Additionally, the reduction in trigger reach and grip circumference of compact designs increases concealability and is thought to enhance shooting ergonomics. Compact designs are available for both low-powered and high-powered cartridges.

In some prior art compact pistols, there is a limit on the reduction in size of the pistols. The size limit is due to the fact that the guide rails and locking block are separate components. Given the separation of guide rails and locking block, and the configuration of prior art frames, a minimum distance between the guide rails and locking block is necessary.

SUMMARY OF THE INVENTION

Accordingly, it is an object of the present invention to provide a locking block mechanism that combines the normally separate guide rails with the locking block facilitating the construction of a pistol that is more compact than prior art designs.

An additional object of the present invention is to provide a locking block mechanism with fewer components by combining the normally separate guide rails with the locking block.

A further object of the present invention is to provide a locking block mechanism in which the guide rails and locking block are a single unitary component.

A preferred embodiment of the present invention is a locking block for a compact semi-automatic pistol having a frame, a slide, a barrel and a firing mechanism. The locking block includes a front end having a substantially unshaped opening and a rear end. The block also includes laterally spaced side walls, each side wall having a guide rail which engages a longitudinally extending groove formed in the slide and guides the slide forward and rearward relative to the frame of the pistol. The guide rails have front and rear edge surfaces and a bottom surface. The locking block also includes a mechanism for securing the locking block to the frame of the pistol and a mechanism for reducing the relative movement of the block and frame upon discharge of the pistol.

DETAILED DESCRIPTION OF THE PREFERRED EMBODIMENT

Figure 1:
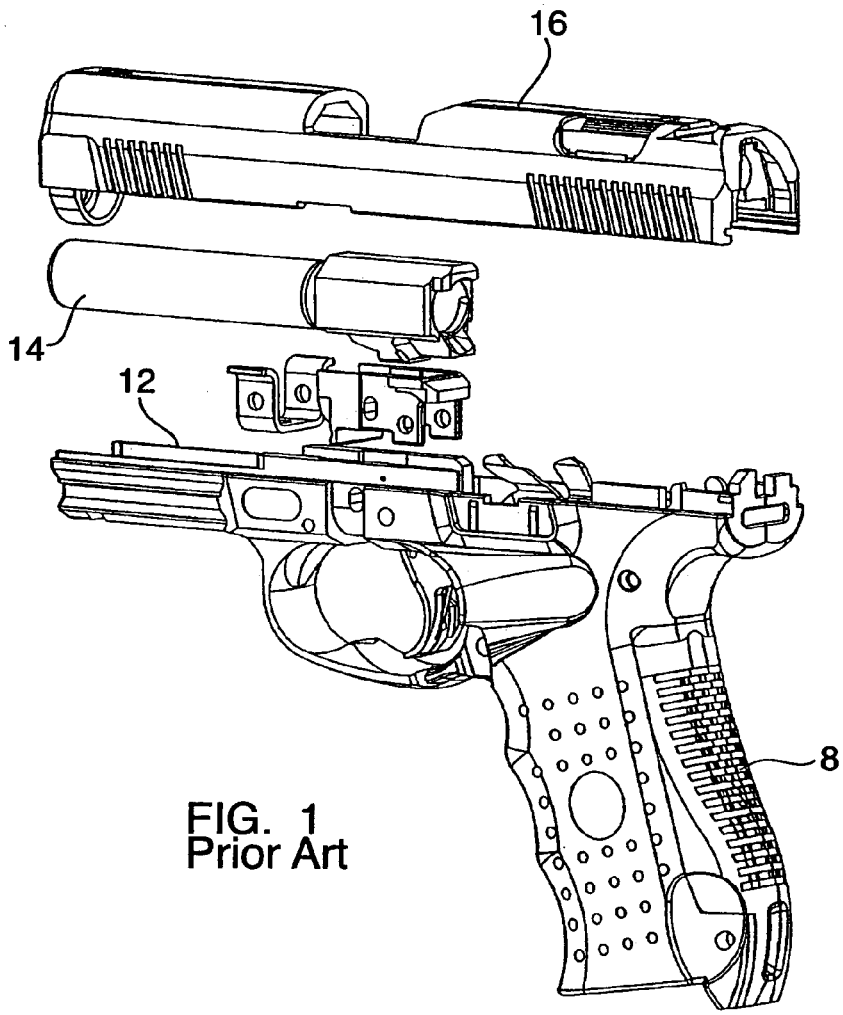
FIG. 1 Prior Art
FIG. 1 is an exploded, perspective view of a semi-automatic pistol containing the prior art-locking block.
Figure 2:
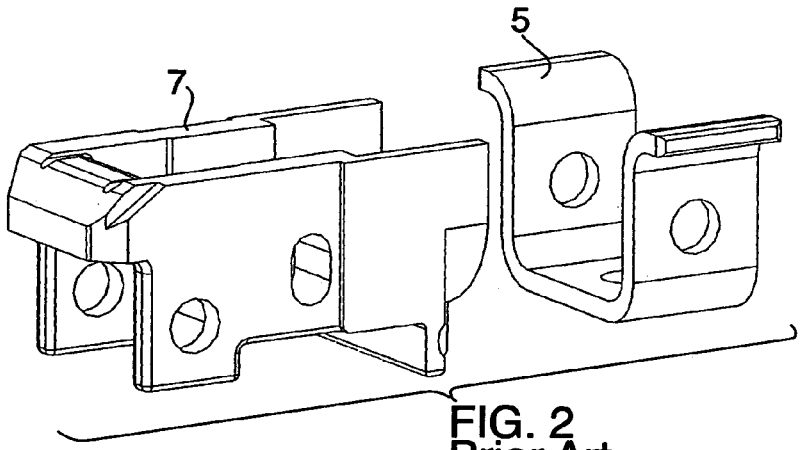
FIG. 2 Prior Art
FIG. 2 is a perspective view on an enlarged scale of the prior art-locking block and forward guide rails shown in FIG. 1.

FIGS. 1 and 2 show prior art locking blocks. FIG. 2 depicts a prior art block in which the guide rails 5 are separate from the block 7. As discussed in detail below, the present invention features a locking block with integral guide rails.

Figure 3:
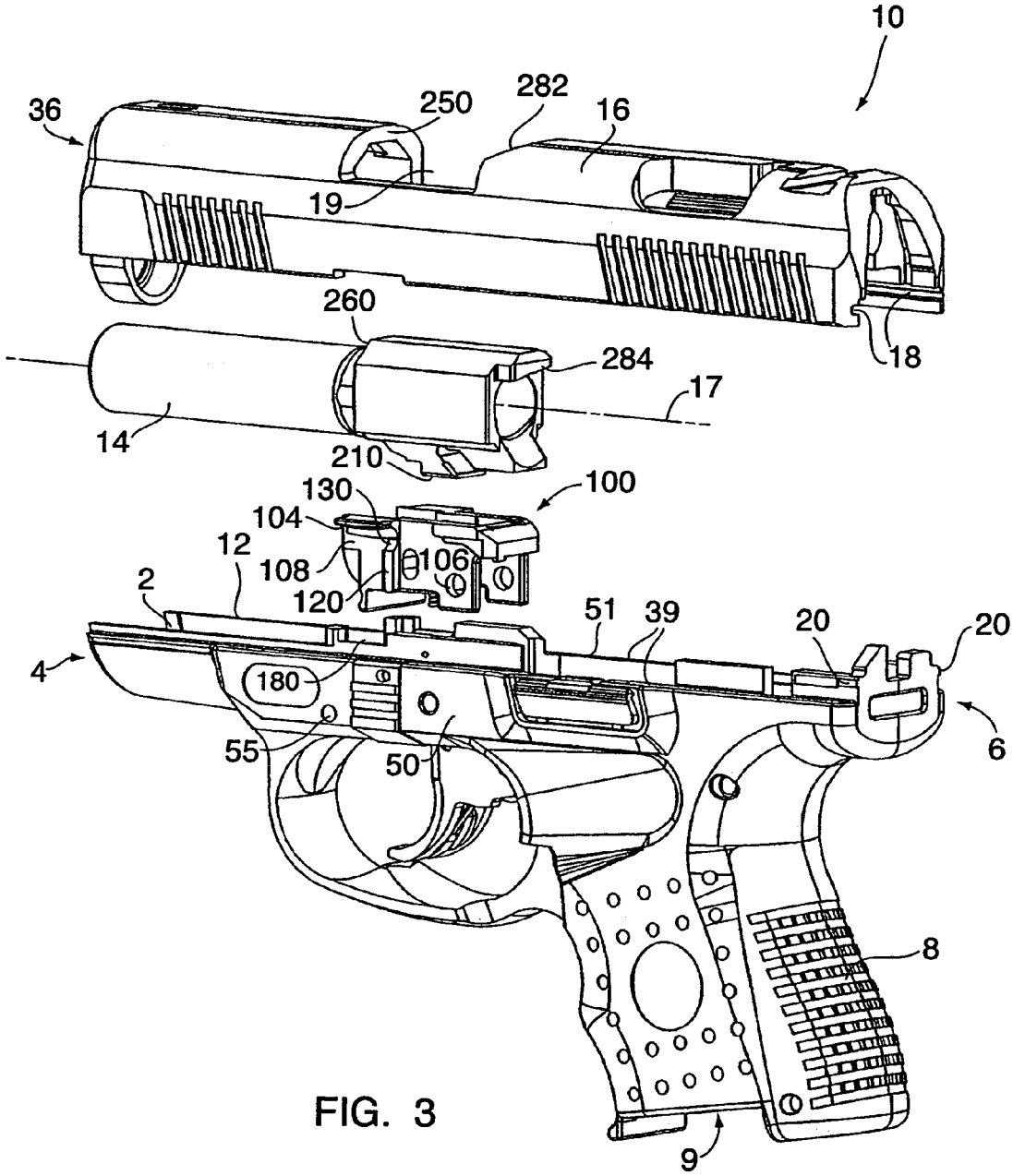
FIG. 3 is a perspective exploded view of a semi-automatic pistol containing a locking block provided in accordance with the present invention.

Referring to FIG. 3, a preferred embodiment of a pistol of the type embodying the present invention is shown. The pistol comprises a polymer frame 12, and a barrel 14 affixed medially of the forward end 4 and after-end 6 of the pistol. A slide 16 is disposed for reciprocal movement relative to the barrel and frame. The barrel has a firing axis 17.

The frame 12 is preferably a unitary structure fabricated by injection molding a high strength, heat and corrosion resistant polymer, such as Nylon 66™.

As will be noted in FIG. 3, the frame 12 comprises an upwardly open channel 2 extending over the length of the frame generally from one end 4 to the other end 6 thereof. A handgrip portion 8 of ergonomic configuration is also shown. The frame is adapted to house a firing mechanism (not shown) and the barrel 14. The handgrip 8 defines a downwardly and upwardly opening chamber 9 adapted to removably receive therein a magazine (not shown).

The slide 16, as its name suggests, is the member which performs the actions resulting from the percussion of the bullet when the trigger is pulled, causing movement of the barrel 14 and the sear of the firing mechanism (not shown). A slide of the type used in the pistol of FIG. 3 is depicted in U.S. Pat. No. 5,386,659, which is hereby incorporated by reference in its entirety. The sear interacts with a striker type firing pin disposed in the rear end portion of the slide 16 with the result being that the firing pin would be cocked or released. When a round in the chamber is fired, the result is energy released thereby, and the slide 16 and the barrel 14 are moved rearward compressing the recoil spring (not shown).

During recoil, the empty shell casing is extracted from the chamber of the barrel 14 by an extractor (not shown) and expelled through the opening 19 in the slide 16. Compression of the recoil spring continues until the kinetic energy, having been imparted to the slide 16, is reduced to a level wherein the potential energy being imparted to the recoil spring as it is being compressed, becomes greater than the kinetic energy. When that occurs, the recoil spring will begin to expand and, in so doing will return the slide 16 to its forward position.

A pair of opposed, inwardly opening and longitudinally extending grooves 18 are disposed at the rear end of the slide 16 as best shown in FIG. 3. The grooves 18 are dimensioned, configured, oriented and spaced apart to engage rear protruding guide rails 20 on the after-end portion of the frame of the pistol. Additionally, bilateral guide rails 104 of the locking block of the present invention engage the longitudinally extending grooves 18 for longitudinally guiding the slide 16 forward and rearward. The bilateral guide rails 104 will be discussed in greater detail below.

The forward portion of the slide 16 is also retained and guided during its movement by the interrelationship of the barrel 14 and slide 16. In that regard, an aperture 36 is provided through a front end wall of the slide 16 and which is adapted to receive therethrough the forward, muzzle end of the barrel 14. The barrel 14 retains the slide 16 in its assembled and parallel relation to the upper edges 39 of the frame 12 and guide its reciprocal, longitudinal motion therealong which occurs whenever the pistol is fired.

Figure 4:
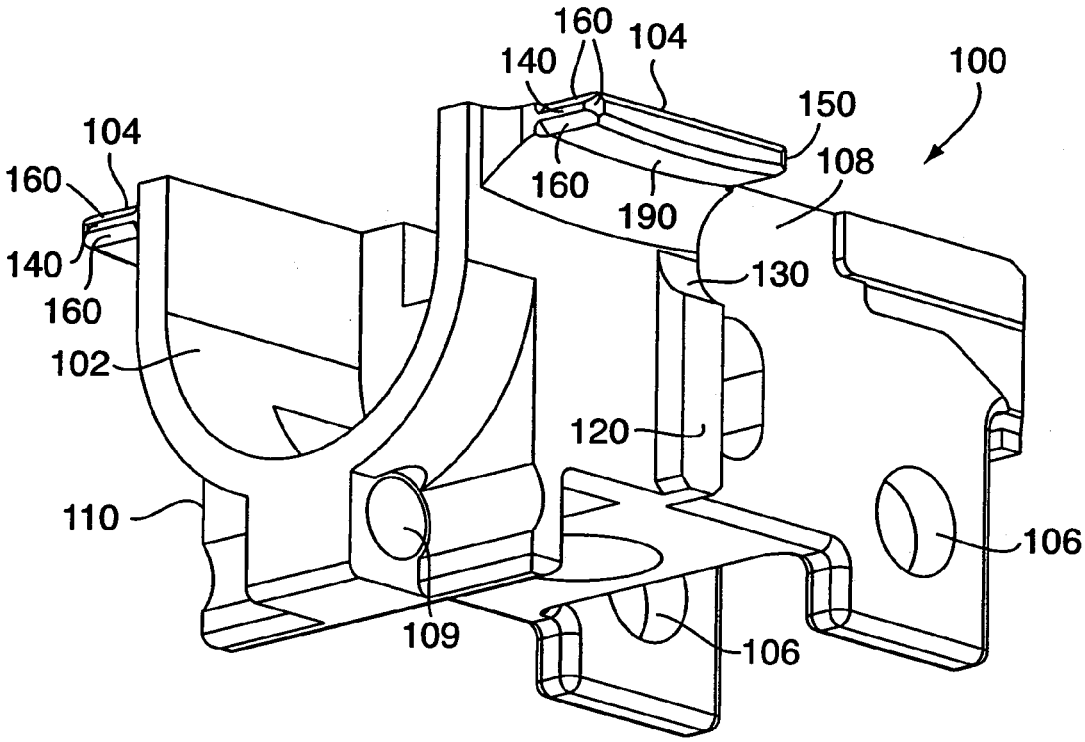
FIG. 4 is a perspective view on an enlarged scale of a locking block provided in accordance with the present invention.
Figure 5:
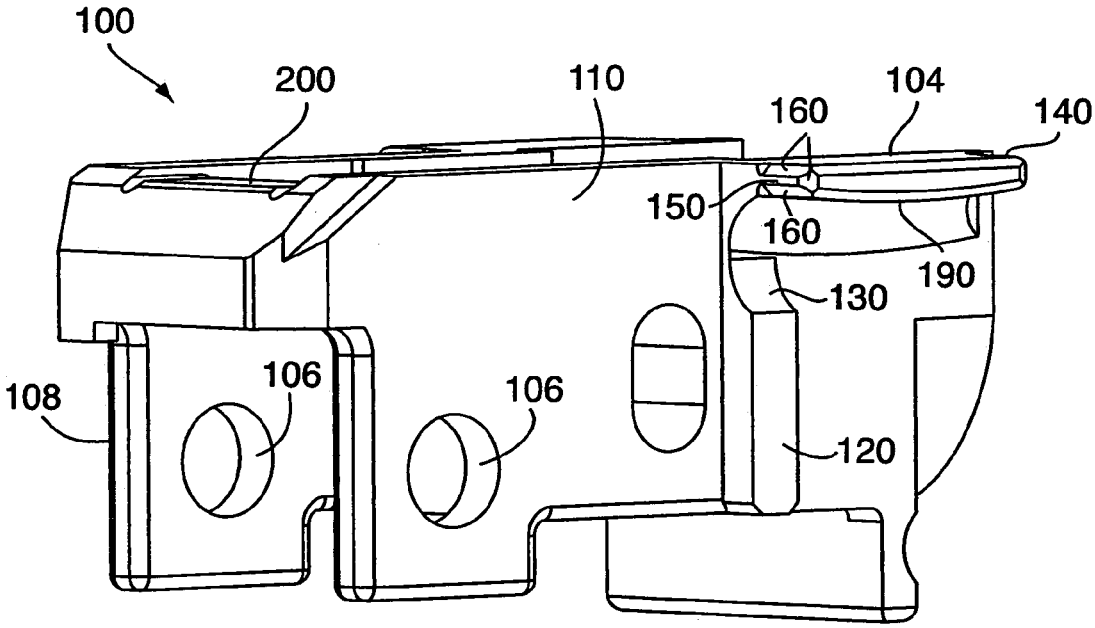
FIG. 5 is an additional enlarged perspective view of the locking block of FIG. 4.

Now referring to FIGS. 4 and 5, the preferred embodiment of the locking block 100 of the present invention includes a front end, relative to the forward end 4 of the frame, which is defined by a substantially U-shaped opening 102. The U-shaped opening acts as a housing for the recoil spring and as a positive stop reinforcement for the slide 16 during firing. The locking block 100 also features bilateral guide rails 104 on the sidewalls 108, 110 of the block.

An important aspect of the present invention is the combination of the bilateral guide rails 104 and the block. Certain prior art locking blocks feature forward or front guide rails that are separate from the locking block and are typically embedded in the frame of the pistol. Prior art guide rails are generally embedded in the frame forward of the block relative to the front of the gun. Given the spacing of guide rails and locking block, and the configuration of prior art frames, a separation between the guide rails and locking block is found. This separation limits the reduction in size of such pistols. By combining the guide rails 104 and the locking block 100, the present invention facilitates the creation of pistols that are more compact than prior art pistols.

Referring again to FIGS. 4 and 5, the locking block 100 has a transverse rib 120 on each block's sidewalls 108, 110. The transverse ribs 120 extend with a form fit into corresponding transverse grooves (not shown) formed in the frame 12.

The transverse ribs are another important aspect of the present invention. Compact pistols are shorter than standard pistols and the overall stroke length of the slide is shorter than in a standard pistol. Since the slide has a shorter stroke length, the slide has greater potential energy at impact compared to standard size pistols and can forcibly impact the locking block or frame with considerably more force than in a standard size pistol. Given the shortened overall stroke length, there may be the potential for overstress in the frame and locking block of compact pistols. The transverse ribs 120, and corresponding grooves in the frame 12, distribute the force of the slide over a greater area. The ribs 120, along with locating pins, also reduce the relative movement of the block and the frame upon discharge of the pistol.

Additionally, by decreasing the distance between the guide rail pairs, the recoil force of the slide is distributed over a shorter length and smaller area. As discussed above, in the present invention the guide rails are combined with the locking block. In light of the above, the transverse ribs 120 are important in that they help distribute the increased forces over a greater area.

Referring now to FIGS. 3 and 4, in its preferred embodiment, the block 100 has a transverse bore 106, which passes through the sidewalls of the block 108, 110. When the block is inserted into the frame 12, the transverse bore 106, is in alignment with transverse bores or openings in the sidewalls 50, 51 of the frame 12. A pin (not shown) is inserted into the bores to secure the block 100 to the frame 12. Additionally, there is a transverse bore 109 directly below the U-shaped opening 102 which accepts a pin (not shown) to secure the block to the frame of the pistol through transverse bores 55 in the frame.

Figure 6:
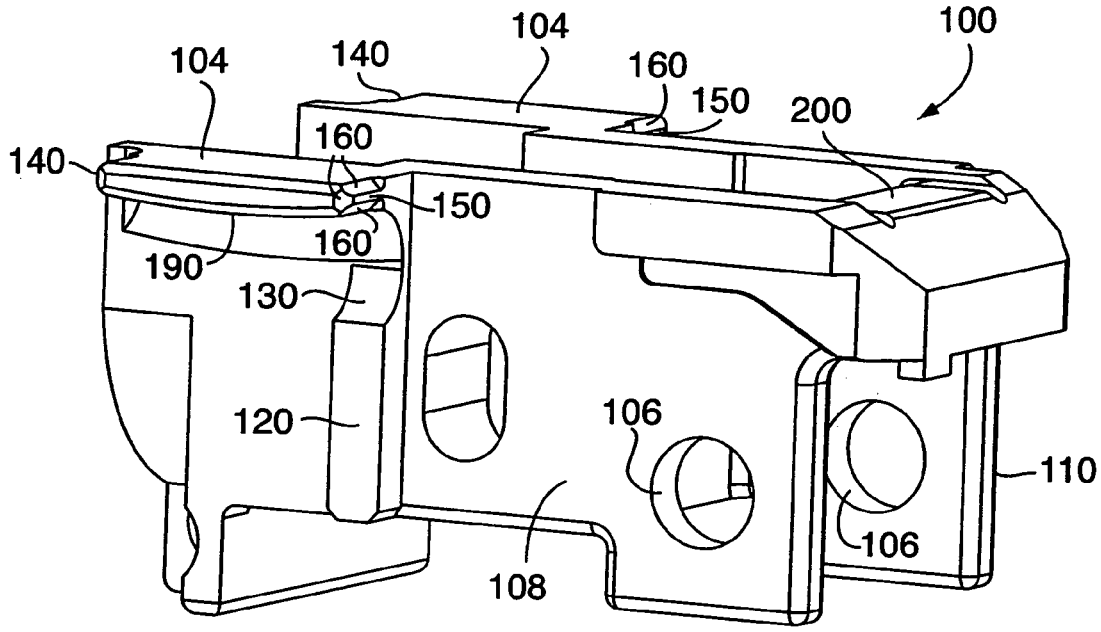
FIG. 6 is an enlarged perspective view of the locking block illustrating the radii on and below one of the guide rail and illustrating the chamfered edge surfaces, as shown in FIG. 4.
Figure 7:
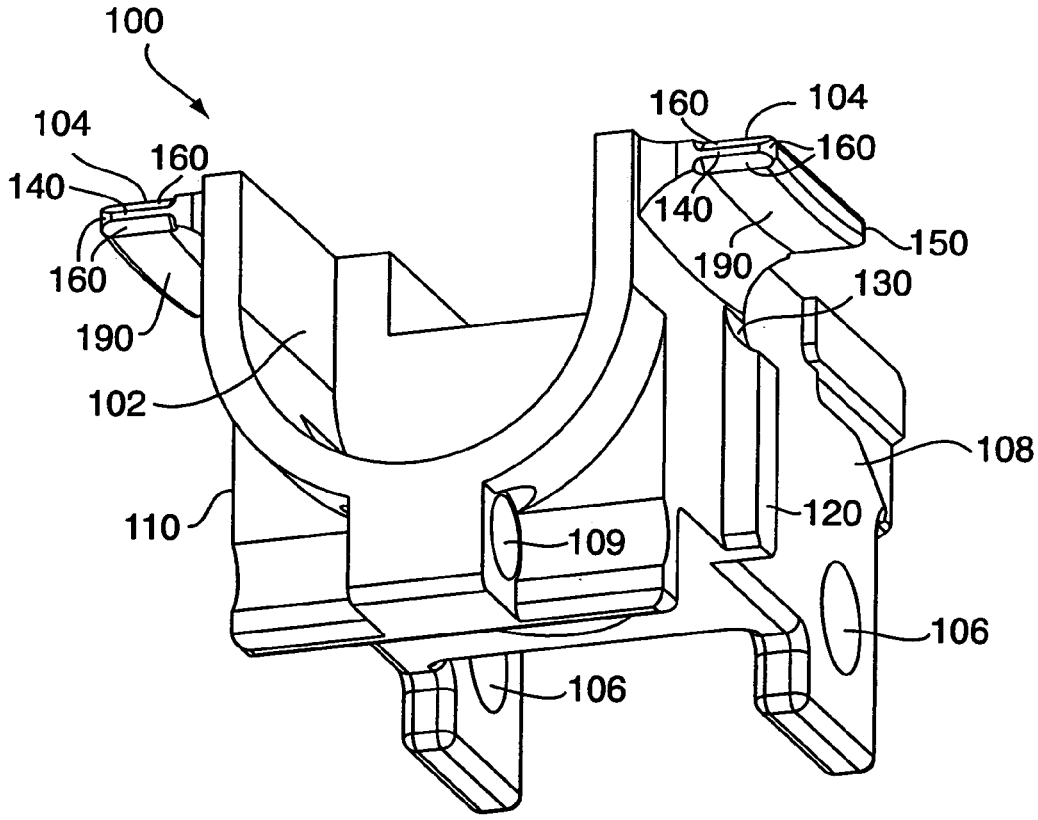
FIG. 7 is an enlarged perspective view of the locking block of FIG. 4 showing the substantially U-shaped opening for the recoil spring and illustrating the chamfered edge surfaces of the guide rails.

Referring to FIGS. 6 and 7, in its preferred embodiment, the transverse ribs 120 are located below the bilateral guide rails 104 on both sidewalls 108, 110 of the block. The surface of the transverse ribs 120 begin at the lower surface of the sidewalls of the block. The surface of each of the transverse ribs 120 continues upward away from the frame toward the slide of the pistol. The surface of each of the ribs terminates with a corresponding discontinuity. The discontinuity is preferably a relieved, radiused surface 130 which separates the rib 120 from the bilateral guide rail 104. Referring to FIG. 7, the radiused surface 130 forms the underside of the bilateral guide rails 104 improving the durability of the block 100 and reducing the drag between the slide and the block.

The radiused surfaces 130 are another important aspect of the present invention. As mentioned above, the radiused surfaces 130 increase the durability of the locking block 100. It is known that where a first surface intersects a second at a 90 degree angle or at an acute angle, an area of concentrated stress is created at the point of intersection. The radiused surfaces 130 prevent such an area from forming between the bilateral guide rails 104 and the ribs 120. Such an area would be undesirable given the force of the slide on the guide rails 104 and locking block 100 upon discharge of the pistol.

Figure 8:
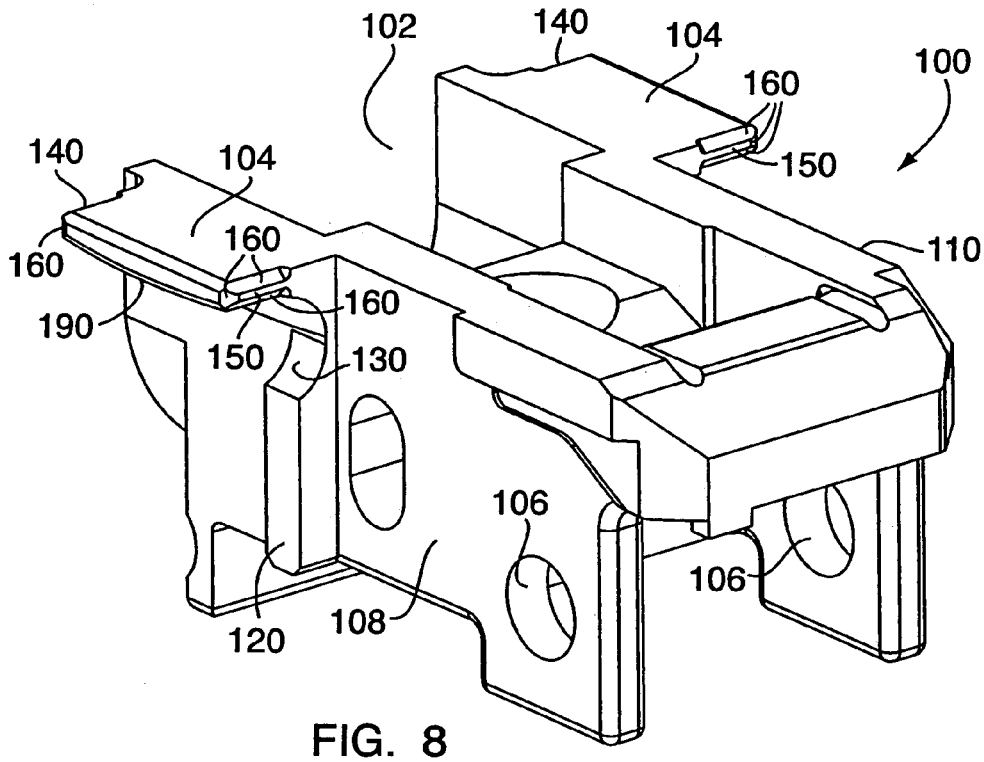
FIG. 8 is an enlarged perspective view of the locking block of FIG. 4 illustrating the chamfered rear edge surface of a guide rail and the radius along the bottom surface of a wing.
Figure 9:
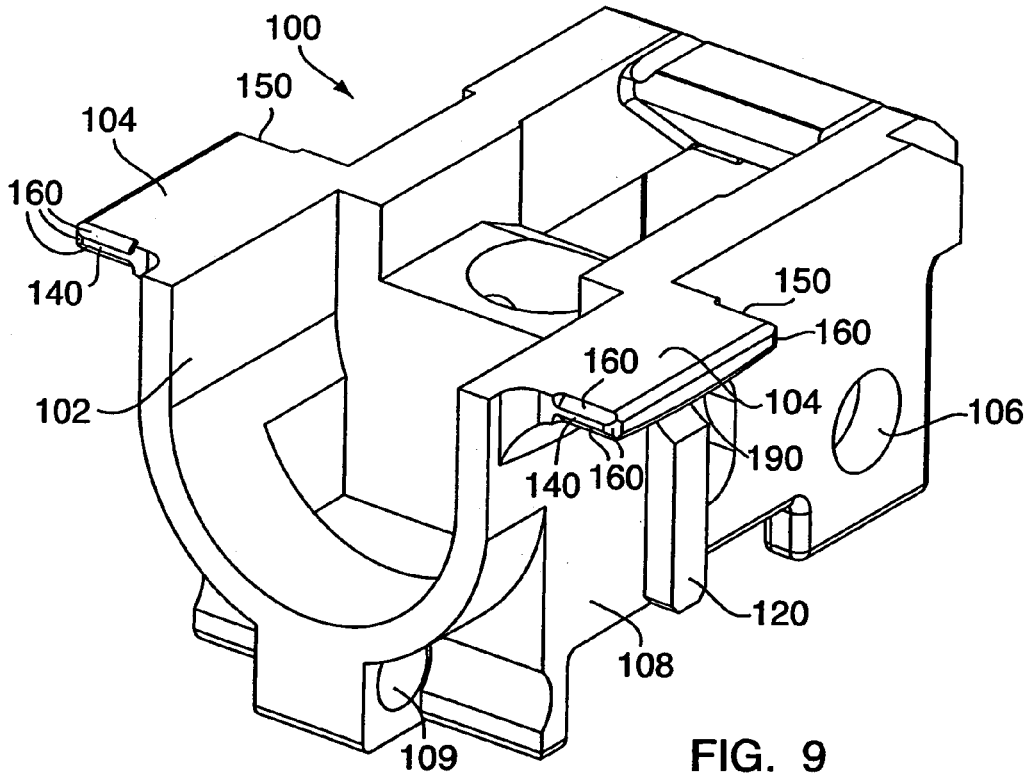
FIG. 9 is an enlarged perspective view of the locking block of FIG. 4 illustrating the chamfered front edge surfaces of the guide rails.

Referring now to FIGS. 7–9, in the preferred embodiment, both of the bilateral guide rails 104 include a front edge 140 and back edge 150, relative to the forward end 4 and after end 6 of the pistol (FIG. 3), which have chamfered surfaces 160. The edges are chamfered such that an upper and lower portion of each edge are cut away at an angle resulting in three surfaces 160 per front edge 140 and back edge 150 of each guide rail. In its preferred embodiment, each chamfer in the edge surfaces 140, 150 have an approximately 0.4 mm cut at a chamfer angle of approximately 45°.

The chamfered surfaces 160 are yet another important aspect of the present invention. As mentioned above, certain prior art pistols have guide rails that are molded into the frame of the pistol. Such guide rails are molded into the frame at high tolerances. The guide rails 104 of the present invention are received by the frame together with the locking block 100. Given that the guide rails are received by the frame as opposed to molded, it may be possible for the longitudinally extending grooves 18 of the slide to pinch the guide rails as the slide moves longitudinally upon discharge. The chamfered surfaces 160 reduce the possibility of such pinching.

Referring now to FIG. 8, in its preferred embodiment, the guide rails also have an arcuate, convex bottom surface 190. The convex bottom surface 190 along with the chamfered front and back edges 140, 150 prevent the slide, upon discharge of the pistol, from binding or overstressing the locking block. The bilateral guide rails 104 protrude from the frame, for engagement with the longitudinally extending grooves 18, through longitudinal openings 180 in the frame 12.

Referring to FIG. 8, in its preferred embodiment, the block has a crossbar 200 at the rear end of the block. The crossbar 200 halts the rearward longitudinal movement of the barrel 14 upon discharge of the pistol and unlocks the barrel from the slide as discussed below.

Referring now to FIGS. 3 and 8, when the pistol is discharged, the recoil forces cause the rearward longitudinal movement of the slide 16. Movement of the slide 16 causes the rearward longitudinal movement of the barrel 14 as well in that the barrel 14 and slide 16 are locked. The slide 16 causes the barrel 14 to move longitudinally rearward by the abutting engagement of a frontwardly oriented end face 260 of the barrel and the forward shoulder 250 of the opening 19 in the slide 16.

Referring to FIGS. 3 and 8, in its preferred embodiment the barrel also includes on its rearward underside a follower lug 210. The follower lug 210 runs onto the cam track 280 of the block and engages the transversely oriented cross bar 200 of the block. The cam surface 280 and crossbar 200 force the rearward end of the barrel to drop down such that the end face 260 of the barrel and the forward shoulder 250 of the opening 19 disengage allowing the slide 16 to continue its rearward recoil motion. When the slide 16 has reached the end of its longitudinal rearward motion it is urged forward by the spring. The slide moves forward until the rearward shoulder of the slide 282 engages the rearwardly oriented end face of the barrel 284 returning the barrel and slide to their locked ready to fire configuration.

Although this invention has been shown and described with respect to an exemplary embodiment thereof, it should be understood by those skilled in the art that the foregoing and various other changes, omissions, and additions in the form and detail thereof may be made therein without departing from the spirit and scope of the invention.

What is claimed is:

1. A locking block for a compact semi-automatic pistol having a frame, a slide, a barrel and a firing mechanism, said locking block comprising:

a front end having a substantially u-shaped opening;

a rear end including a crossbar transverse to a firing axis of the pistol, said transverse crossbar engages the barrel and halts the rearward longitudinal movement of the barrel upon discharge of the pistol and guides the barrel between a locked and unlocked position;

laterally spaced side walls, each side wall having a guide rail which engages a groove formed in the slide, said grooves and guide rails extending in a plane parallel to a firing axis of the pistol, said grooves and guide rails guides the slide forward and rearward relative to the frame of the pistol;

said guide rails having front and rear edge surfaces and a bottom surface, said front and rear edge surfaces being located on opposing ends of the guide rails and extending in planes that intersect the plane of the firing axis of the pistol;

a means for reducing the relative movement of the block and frame upon discharge of the pistol; and wherein said front end, rear end, transverse crossbar, side walls and guide rails are unitary component.

2. The locking block of claim 1 wherein said front and rear edge surfaces of the guide rails are chamfered reducing the surface area of the guide rails in contact with the slide of the pistol.

3. The locking block of claim 1 wherein the means for reducing relative movement includes a rib transverse to the firing axis of the pistol located on each side wall of the block, the transverse ribs engage grooves located in the frame of the pistol.

4. A locking block for a compact semi-automatic pistol having a frame, a slide, a barrel and a firing mechanism, said locking block comprising:

a front end having a substantially u-shaped opening;

a rear end including a crossbar transverse to a firing axis of the pistol, said transverse crossbar engages the barrel and halts the rearward longitudinal movement of the barrel upon discharge of the pistol and guides the barrel between a locked and unlocked position;

laterally spaced side walls, each side wall having a guide rail which engages a groove formed in the slide, said grooves and guide rails extending in a plane parallel to a firing axis of the pistol, said grooves and guide rails guides the slide forward and rearward relative to the frame of the pistol;

said guide rails having front and rear edge surfaces and a bottom surface, said front and rear edge surfaces being located on opposing ends of the guide rails and extending in planes that intersect the plane of the firing axis of the pistol;

a means for reducing the relative movement of the block and frame upon discharge of the pistol;

a means for securing the locking block to the frame of the pistol further comprises bore transverse to the firing axis of the pistol which aligns with a transverse bore in the frame of the pistol and accepts a pin to secure the block to the frame; and wherein said front end, rear end, transverse crossbar, side walls and guide rails are unitary component.

5. A locking block for a compact semi-automatic pistol having a frame, a slide, a barrel and a firing mechanism, said locking block comprising:

a front end having an substantially u-shaped opening;

a rear end;

laterally spaced side walls, each side wall having a guide rail which engages a longitudinally extending groove formed in the slide and guides the slide forward and rearward relative to the frame of the pistol, said guide rails having front and rear edge surfaces and a bottom surface, said front and rear edge surfaces of the guide rails are chamfered reducing the surface area of the guide rails in contact with the slide of the pistol, said bottom surface of the guide rails is convex further reducing the surface area of the guide rails in contact with the slide of the pistol; and a means for reducing the relative movement of the block and frame upon discharge of the pistol.

6. The locking block of claim 5 wherein the front and rear edge surfaces each have upper and lower portions, said upper and lower portions each having a cut-away portion at a chamfer angle of about 45 degrees relative to a firing axis of the pistol resulting in three surfaces per front and rear edge surface.

7. The locking block of claim 5 wherein the means for reducing relative movement includes a rib transverse to the firing axis of the pistol located on each side wall of the locking block, the transverse ribs engage grooves located in the frame of the pistol, said ribs extending transversely along only a portion of the side walls such that there is a discontinuity between the ribs and the guide rails.

8. The locking block of claim 5 wherein the means securing the locking block to the frame of the pistol further comprises a bore transverse to a firing axis of the pistol which aligns with a transverse bore in the frame of the pistol and accepts a pin to secure the block to the frame.

9. The locking block of claim 5 wherein the rear end of the block includes a crossbar transverse to a firing axis of the pistol, said transverse crossbar engages the barrel and halts the rearward longitudinal movement of the barrel upon discharge of the pistol.

10. A compact semi-automatic pistol comprising:

a frame;

a barrel mounted on the frame, said barrel having a firing axis;

a slide reciprocally mounted on the frame; and a locking block, said locking block having a front end with a substantially u-shaped opening, a rear end, laterally spaced side walls, each side wall having a guide rail which engages a groove formed in the slide, said grooves and guide rails extending in a plane parallel to a firing axis of the pistol, said grooves and guide rails guides the slide forward and rearward relative to the frame of the pistol; said guide rails having front and rear edge surfaces and a bottom surface, said front and rear edge surfaces being located on opposing ends of the guide rails and extending in planes that intersect the plane of the firing axis of the pistol; said locking block further including a means for securing the locking block to the frame of the pistol, said means is a bore transverse to a firing axis of the pistol which aligns with a transverse bore in the frame of the pistol and accepts a pin to secure the block to the frame, and a means for reducing the relative movement of the block and frame upon discharge of the pistol, said means are ribs transverse to the firing axis of the pistol located on each side wall of the locking block, the transverse ribs engage grooves located in the frame of the pistol; and wherein the front and rear edge surface of the guide rails are chamfered reducing the surface area of the guide rails in contact with the slide of the pistol.

11. A compact semi-automatic pistol comprising:

a frame;

a barrel mounted on the frame, said barrel having a firing axis;

a slide reciprocally mounted on the frame; and a locking block, said locking block having a front end with a substantially u-shaped opening, a rear end, laterally spaced side walls, each side wall having a guide rail which engages a groove formed in the slide, said grooves and guide rails extending in a plane parallel to a firing axis of the pistol, said grooves and guide rails guides the slide forward and rearward relative to the frame of the pistol; said guide rails having front and rear edge surfaces and a bottom surface, said front and rear edge surfaces being located on opposing ends of the guide rails and extending in planes that intersect the plane of the firing axis of the pistol; said locking block further including a means for securing the locking block to the frame of the pistol, said means is a bore transverse to a firing axis of the pistol which aligns with a transverse bore in the frame of the pistol and accepts a pin to secure the block to the frame, and a means for reducing the relative movement of the block and frame upon discharge of the pistol, said means are ribs transverse to the firing axis of the pistol located on each side wall of the locking block, the transverse ribs engage grooves located in the frame of the pistol; and wherein the front and rear edge surfaces each have upper and lower portions, said upper and lower portions each having a cut-away portion at a chamfer angle of about 45 degrees relative to the firing axis of the barrel resulting in three surfaces per front and rear edge surface.

12. A compact semi-automatic pistol comprising:

a frame;

a barrel mounted on the frame, said barrel having a firing axis;

a slide reciprocally mounted on the frame; and a locking block, said locking block having a front end with a substantially u-shaped opening, a rear end, laterally spaced side walls, each side wall having a guide rail which engages a groove formed in the slide, said grooves and guide rails extending in a plane parallel to a firing axis of the pistol, said grooves and guide rails guides the slide forward and rearward relative to the frame of the pistol; said guide rails having front and rear edge surfaces and a bottom surface, said front and rear edge surfaces being located on opposing ends of the guide rails and extending in planes that intersect the plane of the firing axis of the pistol; said locking block further including a means for securing the locking block to the frame of the pistol, said means is a bore transverse to a firing axis of the pistol which aligns with a transverse bore in the frame of the pistol and accepts a pin to secure the block to the frame, and a means for reducing the relative movement of the block and frame upon discharge of the pistol, said means are ribs transverse to the firing axis of the pistol located on each side wall of the locking block, the transverse ribs engage grooves located in the frame of the pistol; and wherein the bottom surface of the guide rails is convex, the convex bottom surface reducing the surface area of the guide rails in contact with the slide of the pistol.

13. A compact semi-automatic pistol comprising:

a frame;

a barrel mounted on the frame, said barrel having a firing axis;

a slide reciprocally mounted on the frame; and a locking block, said locking block having a front end with a substantially u-shaped opening, a rear end, laterally spaced side walls, each side wall having a guide rail which engages a longitudinally extending groove formed in the slide and guides the slide forward and rearward relative to the frame of the pistol, said guide rails having front and rear edge surfaces and a bottom surface, said locking block further including a means for securing the locking block to the frame of the pistol, said means is a bore transverse to a firing axis of the pistol which aligns with a transverse bore in the frame of the pistol and accepts a pin to secure the block to the frame, and a means for reducing the relative movement of the block and frame upon discharge of the pistol, said means are ribs transverse to the firing axis of the pistol located on each side wall of the locking block, the transverse ribs engage grooves located in the frame of the pistol;

wherein the rear end of the block includes a crossbar transverse to a firing axis of the pistol, said transverse crossbar engages the barrel and halts the rearward longitudinal movement of the barrel upon discharge of the pistol and guides the barrel between a locked and unlocked position.

* * * * *

UNITED STATES PATENT AND TRADEMARK OFFICE

CERTIFICATE OF CORRECTION

PATENT NO. : 6,993,864 B1
APPLICATION NO. : 10/774667
DATED : February 7, 2006
INVENTOR(S) : Sean O'Clair, Michael J. Poulin and Kevin G. Foley It is certified that error appears in the above-identified patent and that said Letters Patent is hereby corrected as shown below:

Column 6,
Line 64, delete "guides" insert -- guide --.

Column 7,
Lines 7 and 45, after "are", insert -- a --.
Line 30, delete "guides" insert -- guide --.

Column 8,
Lines 32 and 63, after "rails", delete "guides" insert -- guide --.

Column 9,
Line 30, after "rails", delete "guides" insert -- guide --.

Signed and Sealed this

Twenty-seventh Day of June, 2006

JON W. DUDAS
*Director of the United States Patent and Trademark Office*